United States Patent [19]

Seeman

[11] 3,992,007

[45] Nov. 16, 1976

[54] SINGLE SPRING WIRE PLAYING BALL MECHANISM

[76] Inventor: Alex Seeman, Steuben Road, R.D. No. 3, Peekskill, N.Y. 10566

[22] Filed: June 9, 1975

[21] Appl. No.: 585,188

[52] U.S. Cl. ..... 273/95 A; 273/58 C

[51] Int. Cl.[2] ..... A63B 71/02

[58] Field of Search ..... 273/58 C, 95 A, 97, 273/98 R, 101

[56] References Cited

UNITED STATES PATENTS

| | | | |
|---|---|---|---|
| 2,140,411 | 12/1938 | Wood | 273/95 A |
| 2,458,668 | 1/1949 | Wood | 273/95 A |
| 3,342,482 | 9/1967 | Palong | 273/95 A |

FOREIGN PATENTS OR APPLICATIONS

| | | | |
|---|---|---|---|
| 395,099 | 7/1933 | United Kingdom | 273/95 A |

*Primary Examiner*—Anton O. Oechsle
*Assistant Examiner*—Marvin Siskind
*Attorney, Agent, or Firm*—Henry I. Steckler

[57] ABSTRACT

A game apparatus which includes a vertically extending pole having a helical groove therealong and a spring wire having a helical portion disposed in the groove. The wire has a first horizontal end portion having a coiled ball receiving terminus and a second horizontal end portion which is adapted to actuate an alarm near the lower end of the pole.

6 Claims, 1 Drawing Figure

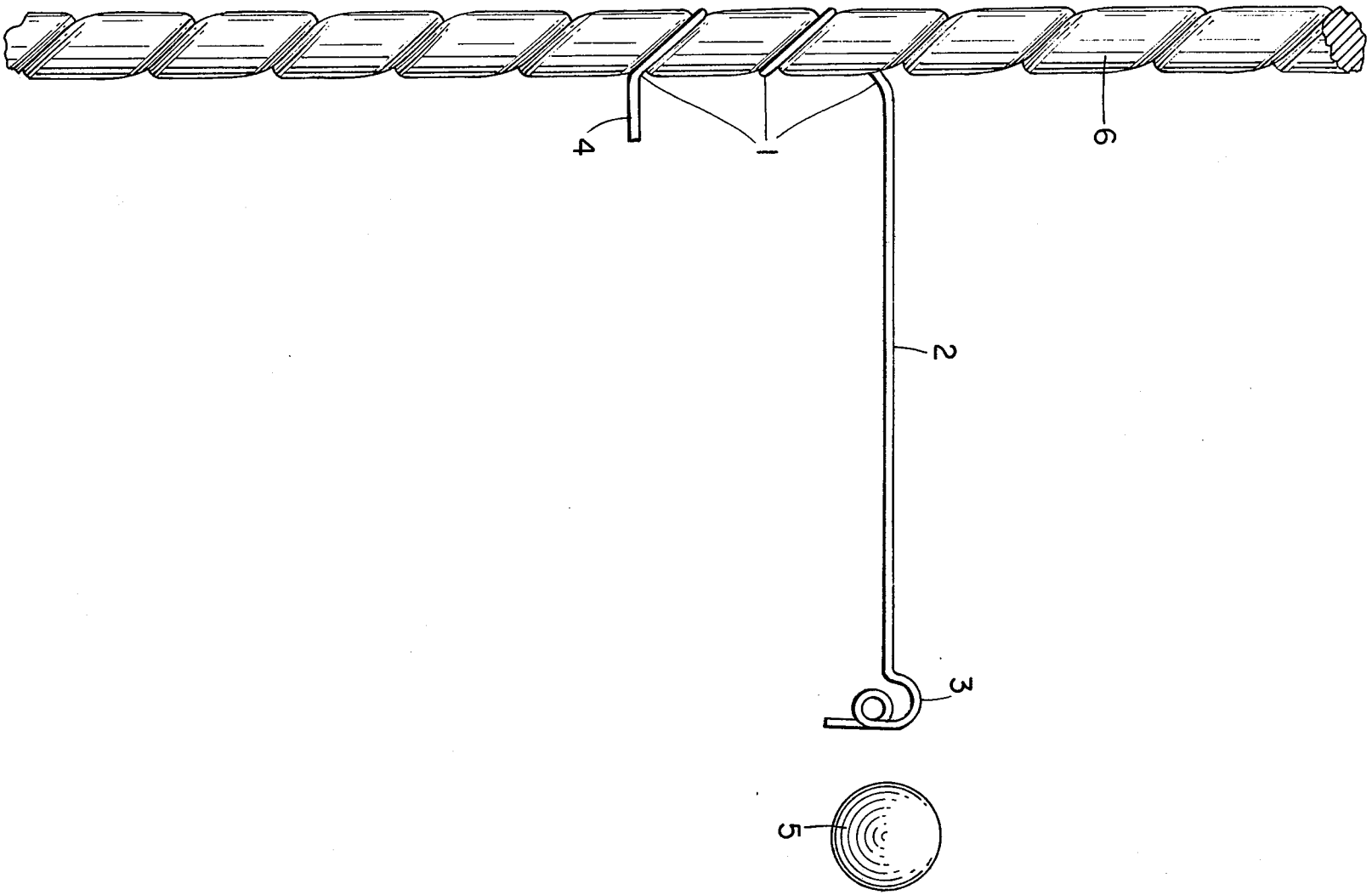
6
2
3
1
4
5

SINGLE SPRING WIRE PLAYING BALL MECHANISM

This invention creates a new paddle ball game that allows a ball to be hit with force and speed as with an outdoor ball game and yet it can be played indoors in an area of approximately 3 × 7 feet with no danger of damaging any of the room's contents or interference with any spectators. The game can be as physically exerting as an outdoor sport such as "paddle ball" or an indoor sport needing a large area.

The object of this invention is a mechanical device, mainly a one piece wire form made of spring steel material that will create an action of a playing ball attached to it, in a unique manner, so to be used in a new physically vigorous indoor (or outdoor) ballgame.

The first part of this wire form is a spiral with two complete coils. This spiral rides in a spiral groove that is cut into and along the length of a pole. When the pole stands upright or vertical on a platform, this part of the wire form, travels north or south in the pole groove while the wire form circles the pole. If it is turned in one direction it will ride upwards and in the other direction it will ride downwards. The action is like a nut on a threaded rod, however, the widely spaced spiral coils riding in its's spiral track, will move much further up or down with each revolution, arriving at it's goal quickly.

The second part of this one piece wire form, extends straight out 90° from the spiral section approximately 16 inches or so. At the end of this extension, a playing ball is attached. This ball when or after being hit will bounce or vibrate at the end of this spring wire extension, making it difficult to hit again.

Therefore the ball, because of this wire form mechanical device, when hit to the left or to the right will travel around the pole, heading north or south whichever the goal of each opponent, standing opposite each other, is. At the same time when not hit directly on purpose or otherwise, the extended wire will cause the ball at the end of it to bounce, making it difficult for the opponent to hit it. A bouncy hit by an individual will also slow down the circling movement in arriving at it's goal.

For further comprehension of the invention, reference will be had to the following accompanying drawing and description, and the appending claims in which the novel features of the invention are set forth.

Referring now to the drawing;

FIG. 1 shows the spiral portion of the wire as it is wrapped around the pole in its spiral groove;

FIG. 2 shows the extension of the wire coming from the spiral;

FIG. 3 shows one and three quarters coils used as a fast means of attaching a hollow playing ball, as described in the appending claims;

FIG. 4 is a small extension of the bottom of the spiral, that serves as a stop at the southern point of the pole, this triggers a sounding device; (the top of the spiral where the extension starts, triggers a sounding device at the northern end);

FIG. 5 represents the hollow playing ball that will be attached to the wire form;

FIG. 6 represents the pole that has the spiral track.

While I have illustrated and described my invention, it is to be understood that I do not limit myself to the precise construction herein disclosed and the right is reserved to all changes and modifications coming within the scope of the invention as defined in the appending claims.

Having thus described my invention, what I claim as new, and desire to secure by United States Letters Patent is:

1. A game comprising a vertically extending pole having a helical groove thereon, and an integrally formed spring wire having a helical portion disposed in said groove, a first horizontal portion, a second horizontal portion adapted to actuate an alarm, and a coiled ball receiving portion at an end of said first horizontal portion.

2. A game as claimed in claim 1 wherein said horizontal portion extends 16 inches.

3. A game as claimed in claim 1 wherein said helical portion comprises two turns.

4. A game as claimed in claim 1 wherein said ball receiving portion comprises one and three quarters coils.

5. A game as claimed in claim 1 further comprising a ball disposed in said ball receiving portion.

6. A game as claimed in claim 1 wherein said first horizontal portion is adapted to actuate another alarm.

* * * * *